United States Patent [19]

Wang

[11] Patent Number: 5,040,394

[45] Date of Patent: Aug. 20, 1991

[54] KEY CHAIN WITH DECORATIVE FUNCTION

[76] Inventor: Gohome Wang, 2nd Fl., No. 10, Lane 88, Sec. 2, Pa Te Rd., Taipei, Taiwan

[21] Appl. No.: 631,237

[22] Filed: Dec. 21, 1990

[51] Int. Cl.[5] ..... A47G 29/10

[52] U.S. Cl. ..... 70/457; 70/456 R; 248/470

[58] Field of Search ..... 70/457, 458, 459, 456 R, 70/456 B; 248/470, 471, 469

[56] References Cited

U.S. PATENT DOCUMENTS

| | | | |
|---|---|---|---|
| 2,875,605 | 3/1959 | Hochman | 70/457 |
| 4,655,428 | 4/1987 | McCrea | 248/470 |
| 4,789,573 | 12/1988 | Jenkinsa | 70/456 R |

FOREIGN PATENT DOCUMENTS

| | | | |
|---|---|---|---|
| 1525209 | 4/1968 | France | 70/457 |

*Primary Examiner*—Robert L. Wolfe

*Attorney, Agent, or Firm*—Morton J. Rosenberg; David I. Klein

[57] ABSTRACT

A key chain with decorative function which has a miniature photo frame connected to its one end and in a size similar to that suitable for the usual decorative plate of a key chain, and on back of the photo frame, a clamp is provided to allow the key ring of the key chain to snap in and thereby form a support permitting the photo frame to uprightly or crossly stand on a table or desk top as a decoration. Pictures preferred by the user may be inserted into the photo frame through a movable clear sheet at the front of the frame. When the key ring is detached from the clamp, the key chain is served as a general key chain.

1 Claim, 2 Drawing Sheets

KEY CHAIN WITH DECORATIVE FUNCTION

BACKGROUND OF THE INVENTION

There are diversiform key chains available in the present market, however, none of them is designed to permit the decorative plate thereof to be uprightly or crossly placed on a table top. The object of this invention is to provide a clamp fixed on the back of the decorative plate of a key chain to receive the key ring thereof, so that the key ring may serve as a support to make the plate uprightly or crossly stand on a table top for decorative purpose. The plate may be designed to be a miniature photo frame so that the user may insert or change different pictures therein based on personal preference. When the key ring is detached from the clamp on the back of the decorative plate connected to the key chain at the opposite end thereof, the user may use it as a general key ring.

BRIEF DESCRIPTION OF THE DRAWINGS

The object of the invention and the means for achieving the object can be completely understood by referring to the following detailed description and the accompanying drawings wherein.

DETAILED DESCRIPTION OF THE PREFERRED EMBODIMENT

Figure 1:
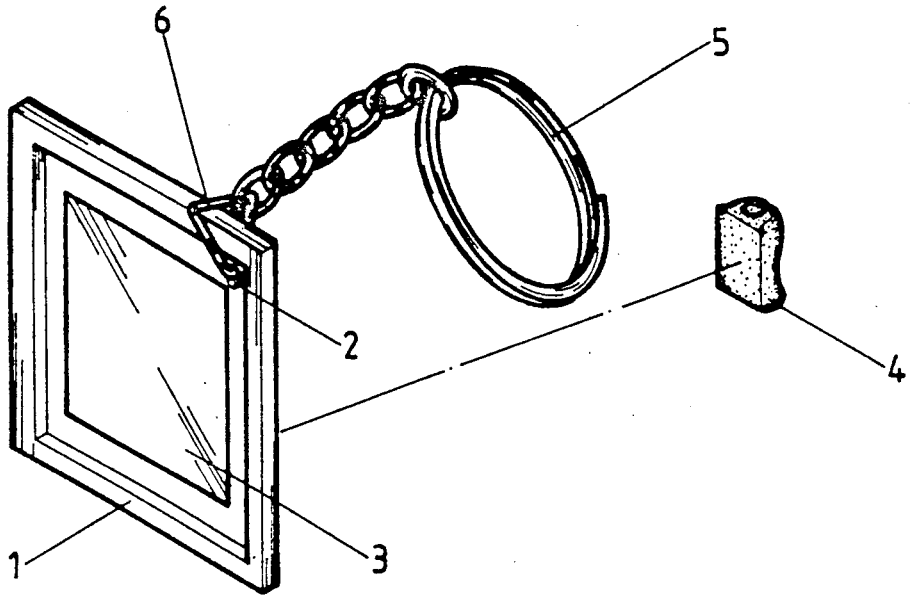
FIG. 1 is a three-dimensional analytical perspective of the present invention.
Figure 2:
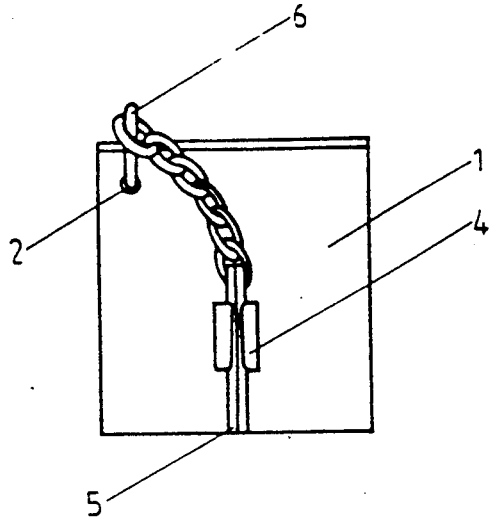
FIG. 2 shows the engagement of the clamp with the key ring of the present invention.

Please refer to FIG. 1. The present invention mainly includes a miniature photo frame 1, a clamp 4, and a key ring 5. The miniature photo frame 1 has a size similar to that suitable for a general decorative plate on a key chain and has a small hole 2 formed at one of it four corners. The front of the photo frame 1 is provided with a movable clear sheet 3 to facilitate the user to insert or change any picture. Please further refer to FIG. 2. The clamp 4 is fixed to the back of the photo frame at a position near the lower center thereof for the key ring 5 to snap in. A retaining ring 6 on the key chain opposite to the key ring 5 is put through the hole 2 to connect the photo frame 1 and the key chain.

Figure 3:
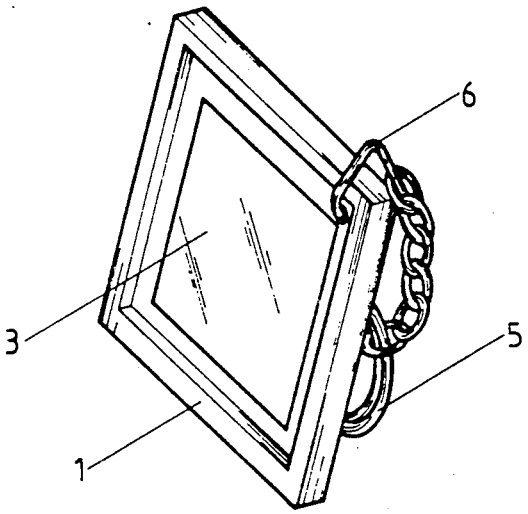
FIG. 3 shows an embodiment of the present invention wherein the key ring is received in the clamp on the back of the decorative photo frame connected on the other end of the key chain.

The present invention may be used either as a usual key chain or as a desk top decoration. The user may put selected picture or photo in the photo frame 1 and snap the clamp 4 and the key ring 5 together to form a support of the photo frame 1, so that the photo frame 1 may stand on a table top as shown in FIG. 3. Moreover, the present invention may be uprightly or crossly positioned, and a vertical and a horizontal clamp 4 may be simultaneously fixed on the back of the photo frame 1. The clamp 4 may be in the shape of arc, semicircle, or cross. The photo frame 1 of the invention is not limited to a fixed type; it is provided with a movable clear sheet so that the user may change picture therein at any time according to personal preference.

I claim:

1. A key chain with decorative function comprising a photo frame having a hole formed at one of its four corners and a movable clear sheet at its front;

a clamping means fixed onto the back of said photo frame at a position near the lower center thereof; and a chain having a key ring at its one end and being capable of snapping into said clamp means, and a retaining ring at its another end and being put through said hole at one corner of said photo frame.

* * * * *